US005838643A

United States Patent [19]

Reiner

[11] Patent Number: 5,838,643

[45] Date of Patent: Nov. 17, 1998

[54] TIMEPIECE DISPLAY AND METHOD OF DISPLAYING INFORMATION TIME ON A TIMEPIECE

[76] Inventor: Daniel J. Reiner, 92 Watkins Ave., Latrobe, Pa. 15650

[21] Appl. No.: 658,843

[22] Filed: May 31, 1996

[51] Int. Cl.[6] ..... G04B 19/00

[52] U.S. Cl. ..... 368/223; 368/228; 368/80; 368/240

[58] Field of Search ..... 368/223, 232, 368/228, 80, 240

[56] References Cited

U.S. PATENT DOCUMENTS

| | | | |
|---|---|---|---|
| 2,065,491 | 12/1936 | Harm | 368/224 |
| 2,243,343 | 5/1941 | Johnson | 368/240 |
| 3,587,222 | 6/1971 | Mestrovic | 368/240 |
| 3,849,978 | 11/1974 | Davis | 368/62 |
| 4,130,987 | 12/1978 | Schickedanz | 368/29 |
| 4,370,068 | 1/1983 | Han | 368/240 |
| 5,410,520 | 4/1995 | Stampfer | 368/240 |

*Primary Examiner*—Bernard Roskoski
*Attorney, Agent, or Firm*—Lawrence R. Burns

[57] ABSTRACT

According to the present invention, there is disclosed a timepiece which comprises a face having a polygonal configuration when viewed in plan and having a timekeeping mechanism coupled with the timepiece face. Along at least one of the sides of the polygon there is provided means for indicating the units of time. The hour of time may be indicated along one side and along another side may be provided means for indicating the minute of the hour. The invention includes additional features wherein the day of the month may be included along another side, and the seconds of the hour may be provided along another side of the polygon. Preferably the time piece, according to the present invention, will comprise an LCD screen which will display a decorative design in either a static or dynamic configuration. The LCD display having a dynamic configuration can provide for configurations that will have lines intersecting the various sides of the polygon such that the intersection points indicate the hour, minute, second or day depending on the preference of the wearer of the timepiece.

11 Claims, 2 Drawing Sheets

TIMEPIECE DISPLAY AND METHOD OF DISPLAYING INFORMATION TIME ON A TIMEPIECE

FIELD OF THE INVENTION

This invention has to do with a timepiece having an unusual method of displaying the time of day and is particularly concerned with a decorative watch or clock that may have a decorative design on the front, that indicates the time in a manner known only to the person wearing or familiar with the timepiece.

BACKGROUND OF THE INVENTION

Watches and/clocks are usually designed with graduations that are marked around the face of the timepiece and internal mechanisms that rotate an hour hand, a minute hand, and a second hand. The typical design of an analog watch face has on its perimeter the numbers 1 through 12, usually increasing in a clockwise direction with rotating hour hands and minute hands that point to the numbers on the watch face perimeter that indicate the exact time of day. When one looks at the watch, clock or timepiece, it is immediately obvious that the article is a timepiece, and decorative features are usually built around the periphery and in the center of numerals that are displayed on the timepiece face.

Watches are usually worn on the wrist of a person, although pocket watches, necklaces and rings have been utilized to carry the timepiece face. Digital watches are also known wherein a time display panel is visible and provides numerals and letters to indicate units of time.

BRIEF SUMMARY OF THE INVENTION

According to the present invention, there is presented a timepiece such as a clock or watch that contains the concept of a new way of displaying the time. The design is not intended to convey the exact time, only a rough approximation, much like a clock face with only two hands and no digits or hashmarks around the face. In the present invention, the hours and minutes (and potentially seconds) are indicated along the sides of a polygon displayed on an LCD screen. The polygon could have any number of sides, and need not be regular, bur for the ease of readability, it is recommended that the polygon have from three to eight boundaries of preferably equal length.

In the concept and method, any one side or more may be arbitrarily chosen to indicate the time with, for example, one side indicating the hours and the other side indicating the minutes. Possibly a third side could indicate the seconds, and a fourth side could indicate the date. Besides choosing different sides to represent the hours, minutes, seconds and or date, the calibrated markings or scales can run in either direction along the side. For example, instead of the minutes increasing from top to bottom on one side, the numbers could increase from bottom to top, or left to right or right to left. The side indicating the minutes could be different and the calibration points could be completely arbitrary markings or points that would allow one to approximate the time to the nearest minute without numerals for the minutes and hour being obviously displayed. For a square, this could indicate that there are 48 possible configuration for the hour and minute. In general, for a polygon with 'N' sides, there would be [N*(N−1)*2* 2] configurations that one could choose when displaying hours and minutes on such a display. The idea of the watch is that there could be an LCD screen that could display any kind of static or dynamic figure or pattern, in monochrome or color. Such figures or patterns are currently used on computer displays and could consist of any design that is decorative or interesting that could go along with any clothing the person is wearing or decor in the room. The current time would be displayed din the decorative design by the location of pixels along the sides or one could the press a button where the decorative pattern would disappear and the polygon would appear with pixels along the sides at the points that would only be known by the wearer. In other words, another person looking at the watch, without knowing the how the graduation of hours and minutes had been determined on the watch, would not know that the pixels are indicating the time of day. Only the person that received the timepiece with the predetermined instructions would know how to tell time on the piece.

As with any digital watch, buttons would be used to set the date and time and the particular logarithm used for displaying the time could either be set at the time the watch is being manufactured, or could possible be owner-configured, the code known only to the owner of the timepiece.

OBJECT OF THE INVENTION

It is an object of the present invention to provide a decorative face for a timepiece such as a clock or watch.

It is an object of the present invention to provide a decorative and unique face for a timepiece with a method of telling time that is only known to the owner.

It is an object of the present invention to provide a timepiece having a polygonal face wherein the units of time are displayed by pixels located along one or more sides of the polygonal face.

It is an object of the present invention to provide a timepiece having a decorative outer face with an activation mechanism that indicates the time in a code known only to the wearer of the timepiece.

It is a further object of the invention to provide a timepiece having a LCD screen that when activated indicates the time of day in a predetermined code.

It is a further object of the present invention to provide a timepiece having a LCD screen that does not have the usual digits or marks around the face of the timepiece.

DETAILED DESCRIPTION OF THE DRAWINGS

Figure 1:
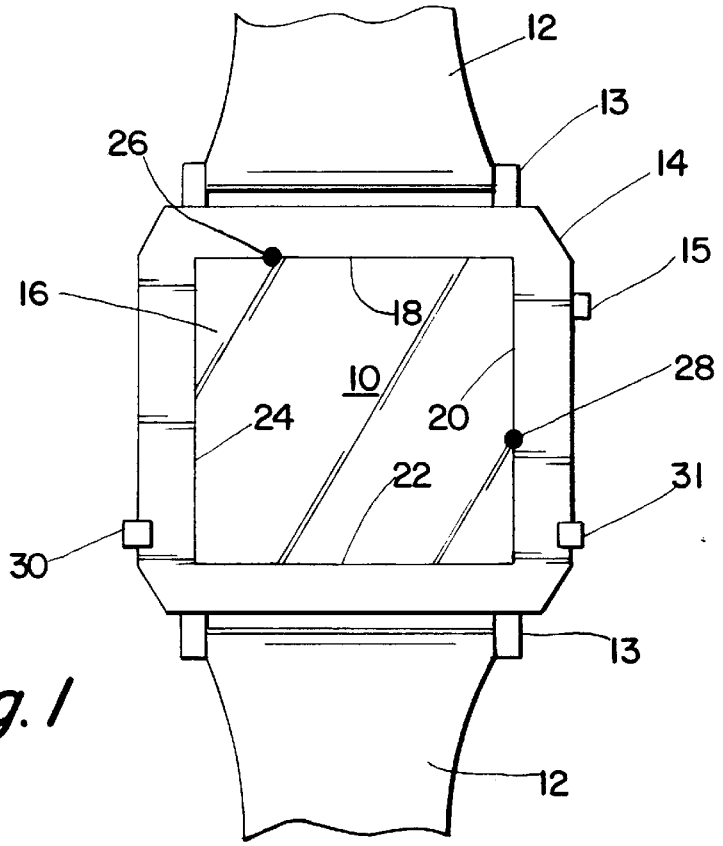
FIG. 1 is a plane view of a timepiece having a LCD display according to the present invention.

What is shown in FIG. 1 is a timepiece 10 having a watchband shown at 12 attached to the timepiece at attachments 13. The actual timepiece 10 has a body 14 that contains an LCD display 16 that may be activated by a button 15. When the LCD display 16 is activated by button 15, the polygonal configuration, especially a square, having sides 18, 20, 22, and 24 is shown on the front of the timepiece. Also shown along the polygonal sides on side 18 especially is a pixel 26 which may indicate either the hour, the minute or the second. Shown also at 28 is a pixel along side 20 that may also indicate the hour, the minute or the second. It is desirable that one may have graduations on side 18 from 1 through 12 so that the hours may be displayed by pixel 26 while along side 20 the minutes may be graduating to sixty so that pixel 28 can indicate the minute of the hour. It is further possible that side 22 would have a pixel located there along that would indicate the exact seconds. When one is dealing with a polygonal configuration, one may have many more sides than four along each side a pixel may be chosen to designate the hour, minute or second or even day if one chooses to put that information into the display piece.

Meanwhile, the LCD display 16 when not activated by button 15 may actually show pastel scenes or other LCD designs that are very decorative in nature. Buttons 30 and 31 could be set to show the date and time on the timepiece.

Figure 2:
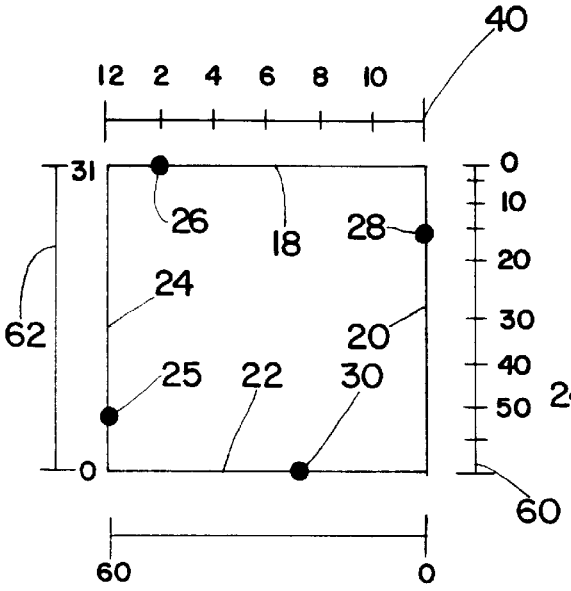
FIG. 2 is a plan view of a possible configuration of a timepiece face according to the present invention.

FIG. 2 shows an example of a polygonal face that may be displayed on the timepiece 10. the polygonal face has sides 18, 20, 22 and 24 as shown in FIG. 1, but in this case, side 18 may be provided with a legend as is shown at 40 whereas side 20 may have a legend as is shown at 60. The legend at 40 may display the hours of the day, where the legend at 60 may display the seconds. Pixels 26 and 28 as referred to on FIG. 1 would now indicate a time of approximately 2 hours and 15 minutes. Additionally another legend may be place along side 22 wherein the seconds are indicated from zero to sixty going across face 22 in which case another pixel may be shown that moves along side 22 in accordance with the correct time of the day with pixel 30. The side 24 may have a legend 62 extending from zero to thirty-one to further indicate the day of the month by a pixel 25. As can be seen in FIG. 2, the legends may be varied extending from one side to another along the polygonal sides so that many variations can be imagined. The legends need not extend from top to bottom or side to side as is shown in FIG. 2, but may be reversed depending on the design of choice of the person wearing the timepiece.

Figure 3:
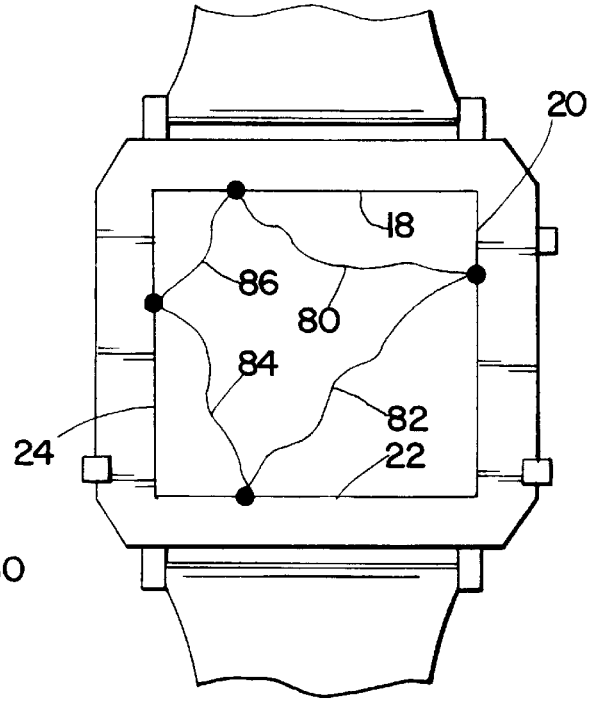
FIG. 3 is a plan view of a possible dynamic timepiece face according to the present invention.

Shown further in FIG. 3 is again the timepiece having sides 18, 20, 22 and 24, but this time having a dynamic LCD display with lines 80,82, 84 and 86. As can be seen in FIG. 3, the changing dynamic LCD display may have lines such as 80 that intersect sides 18 and 20 in different positions as the time of day or day changes and line 82 intersecting side 20 to 22, line 84 intersecting sides 22 to 24 and line 86 intersecting 24 to 18. In this manner or a manner similar to it, it may be possible that the line of dynamic design would be constantly changing as the time of day changes.

Figure 4:
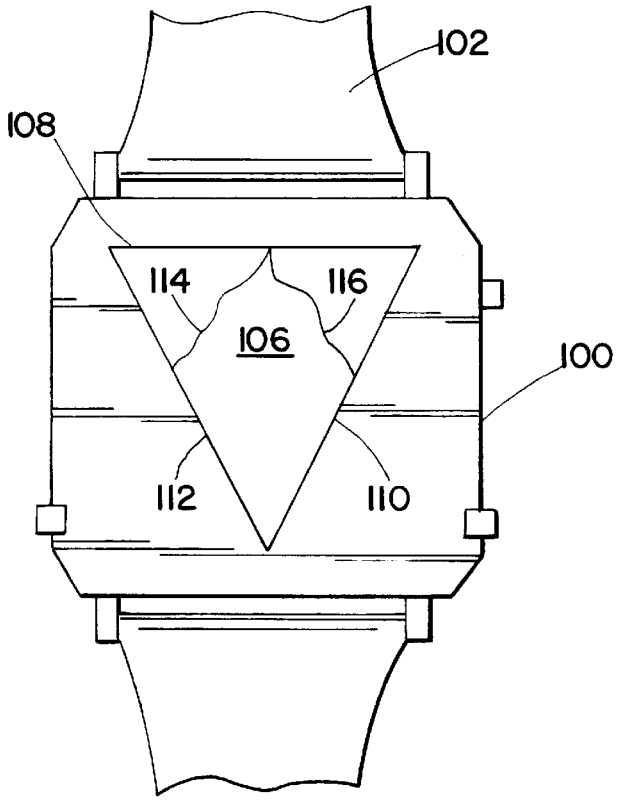
FIG. 4 shows a polygonal configuration of a timepiece display according to the present invention.

What is shown in FIG. 4 is another timepiece 100 wherein there is a watchband 102 to hold the timepiece 100 to the wrist of the wearer. There is a face 104 upon which a decorative display panel is shown at 106 may be mounted. The display panel at 106 is an LCD screen and in this case is shown having a polygonal configuration with sides 108, 110, and 112. The display lines shown at 114 and 116 will be constantly changing depending on how the time changes during the day. Of course, the display can be along side 108 from left to right with the hours of the day progressing from zero to twenty-four, the minuets can be along side 110 with minutes progressing from the top-most part of the timepiece being zero and the bottom-most being sixty, and the seconds can be along side 112 with the lower-most side being zero and the upper-most side being sixty. Hash marks for the watch need not be shown when the wearer of the design realizes or knows that those are the graduations of the particular watch. In this manner, the time of day may be approximated by the wearer viewing the lines 114 and 116 on the changing design and the intersection of sides 108, 110 and 112.

Figure 5:
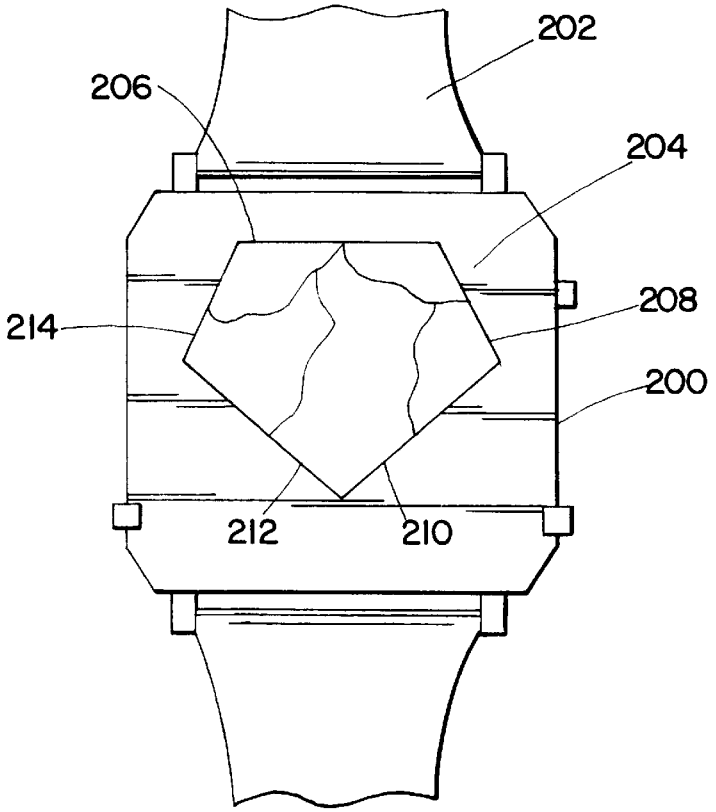
FIG. 5 shows still another polygonal configuration of a timepiece according to the present invention.

What is shown in FIG. 5 is a timepiece 200 having a watchband 202 and having a display face 204. On the display face 204 is a polygonal display panel having sides 206,208,210 and 212. With sides 206,208, 210, 212 and 214, we now may display the hours along sides 206, the minutes along side 208, the seconds along side 210, the month along side 212 and the day along side 214. When used in this manner, again the hash marks need not be shown, and the wearer will only know that along side 206 the hour graduations can go from left to right and be in graduation from zero to sixty. Side 212 would be the month and go from the lowermost side to the uppermost side being zero to twelve, and side 214 would be the day going from one at the lowermost corner to thirty-one at the uppermost corner.

I claim:

1. A timepiece which comprises:

a. a timepiece face having a polygonal configuration when viewed in plan;

b. a timekeeping mechanism coupled with said timepiece face;

c. means for indicating only the hour of item along one side of said polygon;

d. means for indicating only the minute of the hour along another non-parallel one side of said polygon; and e. a decorative design on said timepiece.

2. The timepiece according to claim 1 in which the timepiece face comprises an LCD screen.

3. The timepiece according to claim 2 in which said means for indicating the hour of time in a pixel positioned along said side.

4. The timepiece according to claim 3 in which said means for indicating the minute of said hour is a pixel positioned along said other side of said polygon.

5. The timepiece according to claim 2 in which said decorative design on said timepiece face is a dynamic design.

6. The timepiece according to claim 5 in which said dynamic design has a line that intersects said means for indication of said hours and said minutes.

7. The timepiece according to claim 1 which further includes means for indicating said seconds along another of said one sides different than the sides indicating the hours and minutes.

8. The timepiece according to claim 7 which further includes means for indicating the day of the month along another of one of said sides is different than the sides indicating the hours, minutes and seconds.

9. The timepiece according to claim 7 in which said timepiece is an LCD screen.

10. The timepiece according to claim 9 in which said decorative design is a dynamic design.

11. The timepiece according to claim 10 in which lines from the dynamic decorative design intersect the pixels on the sides indicating the hour, minute, seconds and day.

* * * * *